United States Patent [19]

Duc

[11] Patent Number: 4,610,098

[45] Date of Patent: Sep. 9, 1986

[54] DOUBLE-FLOW DEHYDRATING TUNNEL

[76] Inventor: François Duc, La Sabatière, 24100 Bergerac, France

[21] Appl. No.: 724,903

[22] Filed: Apr. 19, 1985

[30] Foreign Application Priority Data

Apr. 24, 1984 [FR] France ..... 84 06430

[51] Int. Cl.[4] ..... F26B 15/16

[52] U.S. Cl. ..... 34/209; 34/212; 34/227

[58] Field of Search ..... 34/204, 209, 212, 227, 34/228

[56] References Cited

U.S. PATENT DOCUMENTS

| | | | |
|---|---|---|---|
| 1,528,223 | 3/1925 | Moore | 34/227 |
| 2,706,344 | 4/1955 | Vaughn | 34/228 |
| 2,920,398 | 1/1960 | Liljenstrom | 34/228 |

FOREIGN PATENT DOCUMENTS

| | | | |
|---|---|---|---|
| 2269286 | 12/1973 | France . | |
| 2388510 | 12/1978 | France | 34/209 |

*Primary Examiner*—Albert J. Makay

*Assistant Examiner*—David W. Westphal

*Attorney, Agent, or Firm*—Owen, Wickersham & Erickson

[57] ABSTRACT

Double-flow dehydration tunnel characterized in that it comprises, above an intermediate space (5), a collecting and channelling means (20) arranged to collect separately the current of hot air (10) coming from the recycling duct (7) containing the heater (9) and the current of less hot air (15) coming from the recycling duct not containing a heater, to divert these two substantially horizontal currents into substantially vertical currents and to channel them in the form of a multitude of laminar streams (32, 33) parallel to the vertical axial plane of the tunnel, the streams (32, 33) from one source and the other being in alternate positions and axially offset at least on one edge, in such a manner that their mixing produces an air current comprising two zones (34, 35) at different temperatures in the axial direction and substantially homogeneous in the transverse direction, the less hot zone (35) being oriented on the side where the parallel flow section (4) is located.

5 Claims, 5 Drawing Figures

DOUBLE-FLOW DEHYDRATING TUNNEL

The invention relates to dehydrating tunnels, particularly for fruit or agricultural food products, and more particularly relates to double-flow drying tunnels.

A tunnel of this kind was described in French Pat. No. 2,269,286 in the name of the Applicant.

In a tunnel of this kind the products which are to be dehydrated are loaded onto hurdle trucks which travel longitudinally in a drying channel comprising in succession, in the direction of movement of the trucks, a first countercurrent heating section and then a second parallel flow drying section. The two sections are separated by an intermediate space in which no trucks run and into which a current of hot air from a single heater is blown.

In a first version of this apparatus the air passing out at the other end of the parallel flow section is entirely recycled, while that passing out from the countercurrent section on the truck arrival side is entirely evacuated. In this case the fresh air replacing the evacuated air is heated and blown together with the recycled air before being returned to the intermediate space.

In another version of this apparatus the air passing out of the countercurrent section is partly recycled, while the air passing out of the parallel flow section continues to be entirely recycled. The two currents of air thus recycled are drawn in by a single fan action.

In the two abovementioned versions the hot air introduced into the intermediate space in the drying channel has a homogeneous temperature because of the mixing effected by the single fan action.

Another possibility is to blow the fraction of the recycled air flow coming from the countercurrent section through a second fan action direct to the intermediate space in order to save a great length of recycling duct. In this case, still with a single heater but with two fan actions, the air arriving in the intermediate space is not well mixed, being in particular hotter on the parallel flow section side and less hot on the countercurrent section side.

It is moreover known that the maximum temperature which the products undergoing dehydration can withstand without being damaged varies continuously in the course of their dehydration and falls as the same time as the water content of these products. In consequence, in both the first and second versions mentioned above, the temperature of the air introduced into the intermediate space in the drying channel must in practice be limited to the temperature which can be tolerated by the partially dehydrated products which have just passed through the intermediate space in order to start their passage through the parallel flow section. The temperature of the air entering the countercurrent section is in that case necessarily the same, and therefore lower than it could be having regard to the lower degree of dehydration of the products circulating therein. In addition, since this countercurrent section is the section having the higher thermal efficiency, this efficiency is in fact lower than it could be because of this limitation.

In the case of the other possibility contemplated above, the situation is further worsened by the fact that the hottest air arrives at the section inlet where it should be the least hot, and vice versa, so that there is a still greater limitation.

The aim of the invention is to improve still further the efficiency of the installation by eliminating the abovementioned disadvantages, that is to say in particular by making it possible, in the case of the use of two fans, to obtain the most homogeneous temperature possible over the entire air inlet section of each of the countercurrent and parallel flow drying sections, but at the same time to supply to the countercurrent section a flow of air at a temperature slightly higher than that of the air flow in the parallel flow section, while still using only a single heater and without any partitioning across the intermediate space which could impede the circulation of the trucks.

The invention consists in interposing above the intermediate space, between the recycling duct containing the heater and the recycling duct not provided with a heater, a collecting and channelling means of laminated construction, which has the effect of separately collecting the two substantially horizontal currents of air at different temperatures, in order to divert and channel them into a substantially vertical direction in the form of laminar streams parallel to the vertical axial plane of the drying channel, the streams from one source being interlaminated with the streams from the other source and being axially offset, at least on one edge, in such a manner that the substantially vertical current of air resulting from the mixing of these various laminar streams will be less hot on the parallel flow section side.

This collecting and channelling means may in particular, in its simplest form, be composed of a series of triangular partitions whose horizontal base is situated above the intermediate space and whose apex extends to the top wall of the recycling ducts, these triangular partitions being parallel to the vertical axial plane of the duct, in such a manner as to define a certain number of passages, with in addition rectangular closure walls closing the passages corresponding to odd numbers on the side adjoining one of the recycling ducts and closing the passages corresponding to even numbers on the side adjoining the other recycling duct. The axial offset of the laminar streams is obtained by partly closing, on the desired side, the passages of at least one of the categories with the aid of preferably adjustable masks situated substantially in the plane of the bases of the triangles.

Finally, in order to improve the transverse mixing of the two types of laminar streams, the edge of each triangular partition corresponding to the base of the triangle preferably has irregularities for the purpose of creating turbulence.

Other features of the invention will emerge from the description given below of one embodiment taken as an example and illustrated in the accompanying drawings, in which.

Figure 1:
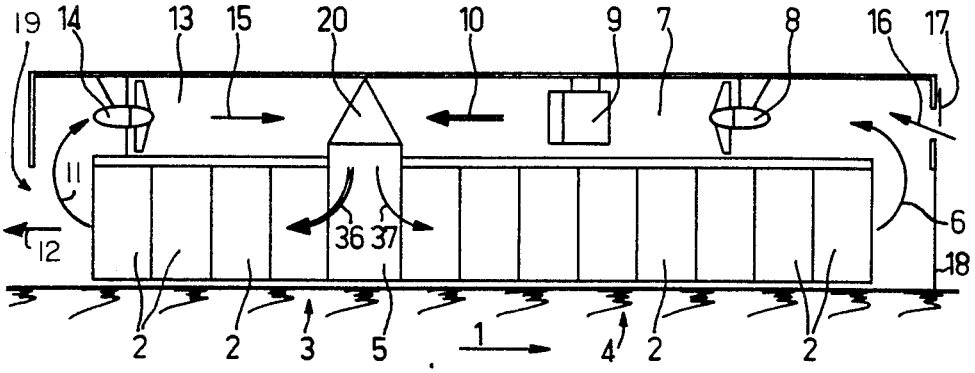
FIG. 1 is a vertical axial section of the installation.
Figure 2:
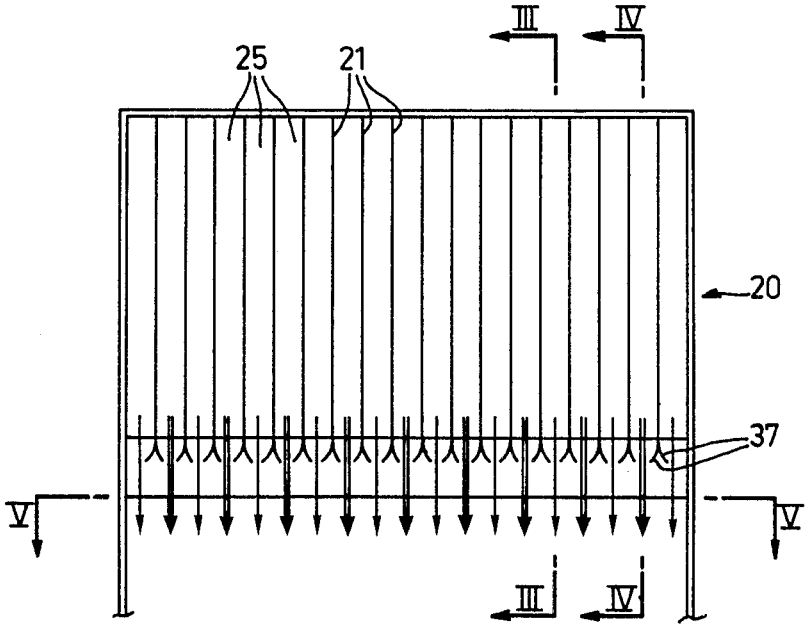
FIG. 2 shows on a larger scale a cross-section of the top part of the installation, containing the collecting and channelling means.

In FIG. 1 the arrow 1 shows the direction of movement of the trucks 2, which circulate in a first countercurrent section 3 and then in a parallel flow section 4, the two sections being separated by an intermediate space 5. The air passing out of the parallel flow section 4 is entirely recycled at 6 into a recycling duct 7 situated above the section 4 of the drying channel and containing a fan 8 and a heater 9. The air arriving at 10 in the direction of the intermediate space 5 is therefore relatively hot.

At the entrance of the tunnel the air passing out of the countercurrent section 3 is partially recycled at 11, while a part 12 of this air is evacuated, the recycled part passing through another recycling zone 13 situated above the countercurrent section 3 of the drying channel and also containing a fan 14. Air which is still hot but relatively less hot than the previously mentioned air thus arrives at 15 in the direction of the intermediate space 5. In order to make up for the current of air evacuated at 12, a corresponding current of fresh air is admitted at 16 on the side where the heater 9 is disposed, with the aid of an adjustable damper 17, while a gate 18 closes the tunnel outlet, although on the other hand the inlet 19 always remains open.

The essential part of the invention consists of the collecting and channelling means 20, whose purpose is to collect separately the hotter air current 10 and the less hot air current 15 and to channel them towards the intermediate space 5. This is the device which is illustrated in detail in FIGS. 2 to 5.

It comprises essentially a series of triangular partitions 21, preferably of sheet metal, disposed parallel to the vertical axial plane of the tunnel with their bases 22 situated horizontally above the intermediate space 5, in line with or slightly above the roofs 23 and 24 separating the sections 3 and 4 of the drying channel from the recycling ducts 15 and 10 respectively.

Figure 3:
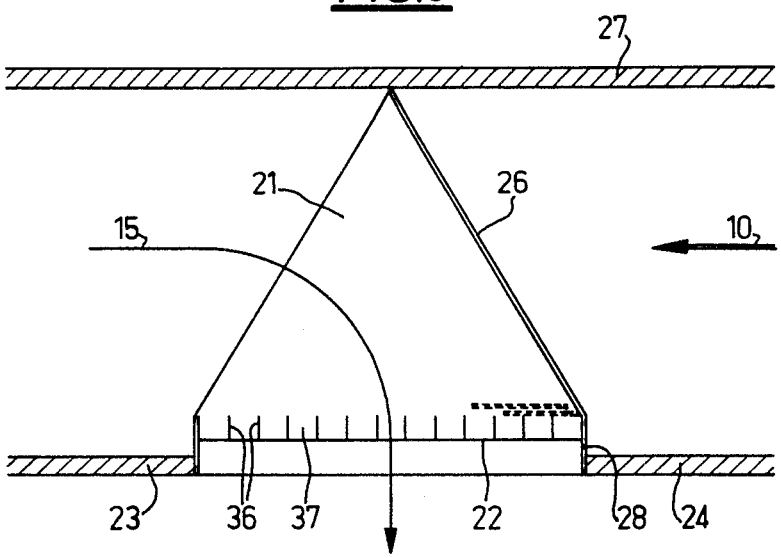
FIG. 3 is a vertical section on the line III—III in FIG. 2.
Figure 4:
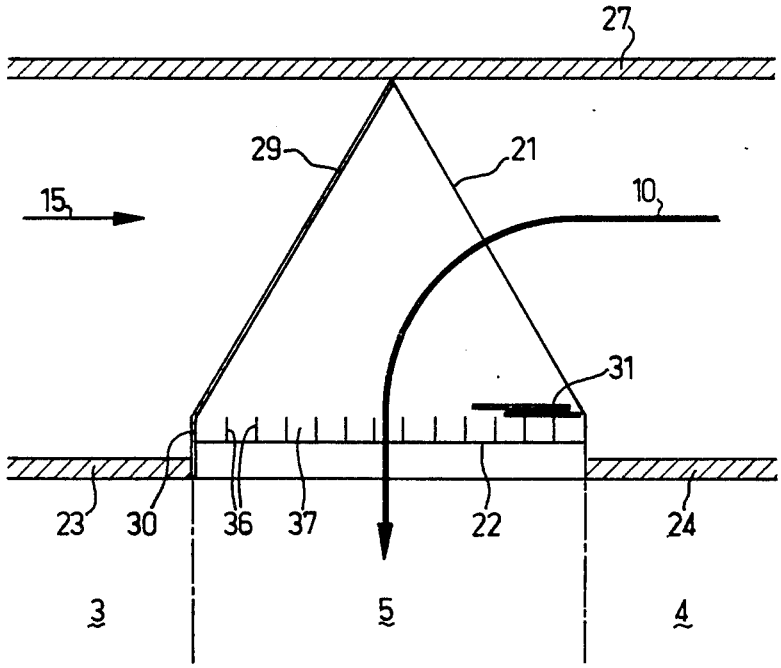
FIG. 4 is a vertical section on the line IV—IV in FIG. 2.

These triangular partitions 21 define between them a certain number of spaces 25, preferably an odd number. As can be seen in FIG. 3, the oddnumbered spaces remain open on the side where the less hot air 15 enters, but are entirely closed by a rectangular partition 26 on the side where the hotter air 10 enters, these rectangular partitions being connected at their top end to the roof 27 of the device and at their bottom end to a vertical flange 28 extending the roof 24. Conversely, the even-numbered spaces 25, as illustrated in FIG. 4, are closed similarly on the side where the less hot air 15 enters by means of rectangular partitions 29 connected to the roof 27 and to a flange 30 on the roof 23, while these spaces remain open on the side where the hotter air 10 enters.

In addition, the even-numbered spaces 25, preferably corresponding to the hotter air as in the example illustrated, are partly closed, on the parallel flow section side, by a preferably adjustable mask 31, a similar mask being provided in each of the even-numbered spaces and being adjustable independently or by means of a single control.

Figure 5:
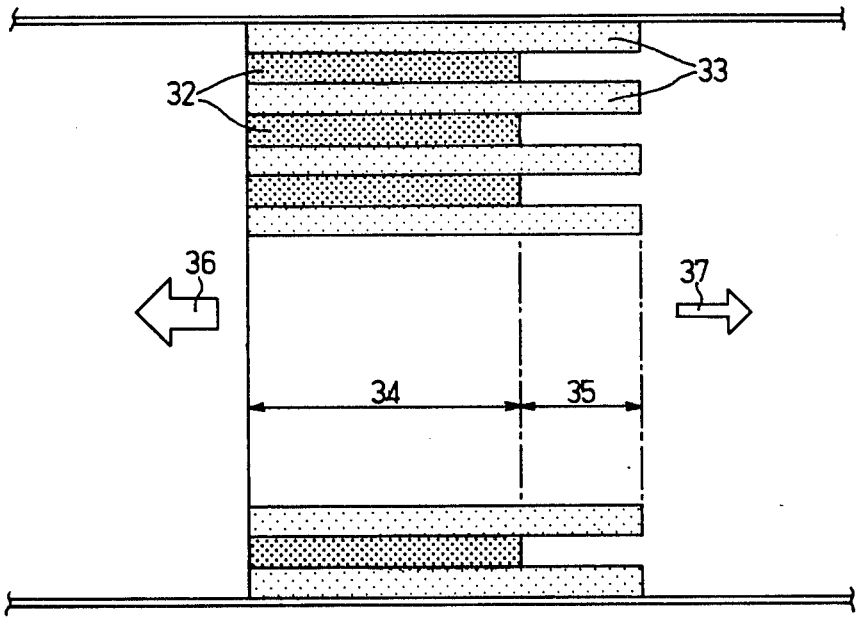
FIG. 5 is a diagrammatical horizontal section on the line V—V in FIG. 2.

The device thus described therefore has the effect of separately collecting the two horizontal air currents 10 and 15, diverting them into a substantially vertical direction, and channelling them in the form of laminar streams of very flattened rectangular section, disposed in alternate positions for each of the two sources, as shown in FIG. 5. In this Figure the stippled zones 32 represent the horizontal section of the streams of hotter air, which therefore enter in the even-numbered position in the case of the equipment described, and the less densely stippled zones 33 represent the horizontal section of the streams of less hot air situated in the oddnumbered position.

If the laminar streams thus defined are sufficiently numerous and sufficiently narrow, the temperature of the air will be very rapidly homogenised in the transverse direction between two adjoining streams, and much more difficultly in the longitudinal direction of the tunnel. A vertical air current is therefore obtained which is practically homogeneous in the transverse direction, while in the longitudinal direction it has two zones 34 and 35 at different temperatures, the hotter zone 34 being reserved for the side where the countercurrent section 3, which can withstand a higher temperature, is situated, and consequently reserving the less hot zone 35 for the side where the parallel flow section 4 is situated.

In order to facilitate transverse homogenization without disturbing the separation of the zones 34 and 35, it may be useful to provide on each of the horizontal edges of the triangles 21 a slight roughness giving rise to air turbulence. The simplest and most effective way of doing this in the case of a sheet metal construction consists in making a certain number of vertical slits 36 of slight length, starting from the bottom edge of the partition 21, and slightly bending in alternate directions the portions 37 remaining between the slits, as can be seen in particular in FIGS. 2 and 3.

The heater 9 is preferably disposed, as in the example illustrated, in the recycling duct 7 situated on the complete recycling side, so that it will act on the maximum current of air. In this case the temperature of the air at 10 is for example 105°, while the temperature of the air 15 recycled on the countercurrent section side is for example 70°, thus making it possible to obtain, for example, a temperature of 90° for the air current 36 corresponding to the zone 34, and a temperature of 85° for the air current 37 corresponding to the zone 35. In this case the paradoxical result is obtained that the hotter evacuated air 36 is situated on the opposite side to the hotter collected air 10.

Nevertheless, it is also possible, as an alternative, to dispose the heater 9 in the other duct 13 if the recycling flow 11 is sufficient, owing to the fact that the invention similarly makes it possible to effect the mixing and differentiation of temperatures by still providing the partial masking of the hot zones 32 on the side where the parallel flow section 4 is situated.

Here again, as an alternative, instead of narrowing the hotter streams in the axial direction, it would also be possible to narrow the less hot streams 33 on the other edge, or else to use both methods simultaneously.

I claim:

1. Double-flow dehydration tunnel having a vertical axial plane, in which trucks (2) carrying products which are to be dehydrated pass generally horizontally in a drying channel through which air flows, comprising in succession a countercurrent section (3) in which the trucks move in a direction opposite to the direction of air flow, an intermediate space (5), and a parallel flow section (4), in which the trucks move in the direction as the air flow, with two recycling ducts respectively recycling all the air (6) passing out of the parallel flow section (4) and a fraction (11) of the air passing out of the countercurrent section (3), these two recycling ducts (7, 12) each containing a fan (8, 14) and one (7) of the ducts containing a heater (9), the two currents (10, 15) of these two recycling ducts being converging currents, converging toward said intermediate space (5) in the drying channel, characterized by the fact that the tunnel is provided, above said intermediate space (5), with a collecting and channelling means (20) arranged to collect separately the current of hot air (10) coming from the recycling duct (7) containing the heater (9) and the current of less hot air (15) coming from the recycling duct (13) not containing a heater, to divert these two substantially horizontal currents into substantially vertical currents and to channel them in the form of a multitude of laminar streams (32, 33) parallel to the vertical axial plane of the tunnel, the streams (32, 33) being in alternate positions and axially offset at least on one edge, in such a manner that their mixing produces a current of air comprising two zones (34, 35) at different temperatures in the direction extending longitudinally of the tunnel and substantially homogeneous in the direction extending transversely thereto, the less hot zone being oriented on the side where the parallel flow section (4) is situated.

2. Tunnel according to claim 1, characterised by the fact that said collecting and channelling means (20) consists of a certain number of triangular walls (21) parallel to the vertical axial plane of the tunnel and defining between them a certain number, preferably an odd number, of laminar spaces (25), the oddnumbered spaces being closed by a rectangular wall (26) situated on the side of one (10) of the convergent currents (15, 10) and open on the other two sides, while the even-numbered spaces are closed by other rectangular walls (29) situated on the side of the other (15) of the two convergent currents (15, 10) and open on the other two sides, masks (31) being provided on one side in the spaces (25) of at least one of the two groups (32, 33) in order to restrict longitudinally the dimension of the corresponding streams (32).

3. Tunnel according to claim 2, characterised by the fact that said triangular partitions (21) are provided along their substantially horizontal base with a series of roughenings intended to produce turbulence promoting transverse homogenisation of temperatures.

4. Tunnel according to claim 3, characterised by the fact that said triangular partitions (21) consist of sheet metal walls and that said roughenings are obtained by cutting successive vertical slits (36) of slight height in the bottom edge of the partition and alternately bending, towards one face and the other, the tabs (37) successively bounded by these slits and by the edge of the metal sheet.

5. Tunnel according to one of claims 2 characterised by the fact that said masks (31) are separately or simultaneously adjustable.

* * * * *